United States Patent [19]

Kinkner et al.

[11] Patent Number: 4,989,359

[45] Date of Patent: Feb. 5, 1991

[54] SHOTGUN HAVING INTERCHANGEABLE BARRELS

[75] Inventors: Bruce E. Kinkner, Phoenix; Alan R. Peck, Scottsdale, both of Ariz.

[73] Assignee: Southwest Shooters Supply, Inc., Phoenix, Ariz.

[21] Appl. No.: 444,320

[22] Filed: Dec. 1, 1989

[51] Int. Cl.[5] ..... F41A 21/06

[52] U.S. Cl. ..... 42/77

[58] Field of Search ..... 42/77

[56] References Cited

U.S. PATENT DOCUMENTS

| | | | |
|---|---|---|---|
| 307,706 | 11/1884 | Brown | 42/77 |
| 834,341 | 10/1906 | Tucker | 42/77 |
| 1,217,162 | 2/1917 | Egbers | 42/77 |
| 1,239,287 | 9/1917 | Masterton | 42/77 |
| 3,138,889 | 6/1964 | Groover | 42/77 |
| 3,339,304 | 9/1967 | Knode, Jr. et al. | 42/77 |
| 3,365,831 | 1/1968 | Wallace | 42/77 |
| 3,384,989 | 5/1968 | Thomas | 42/77 |
| 3,805,434 | 4/1974 | Sudano | 42/77 |
| 3,979,851 | 9/1976 | Soucy | 42/77 |
| 4,735,009 | 4/1988 | Jett, Jr. | 42/77 |

*Primary Examiner*—Charles T. Jordan
*Assistant Examiner*—Richard W. Wendtland
*Attorney, Agent, or Firm*—Cahill, Sutton & Thomas

[57] ABSTRACT

A shotgun having interchangeable barrels includes a barrel support member attached to a standard shotgun action. A plurality of barrels having substantially equal weights are sized and constructed to fit within and attach to the support member in operation relation to the shotgun action.

7 Claims, 2 Drawing Sheets

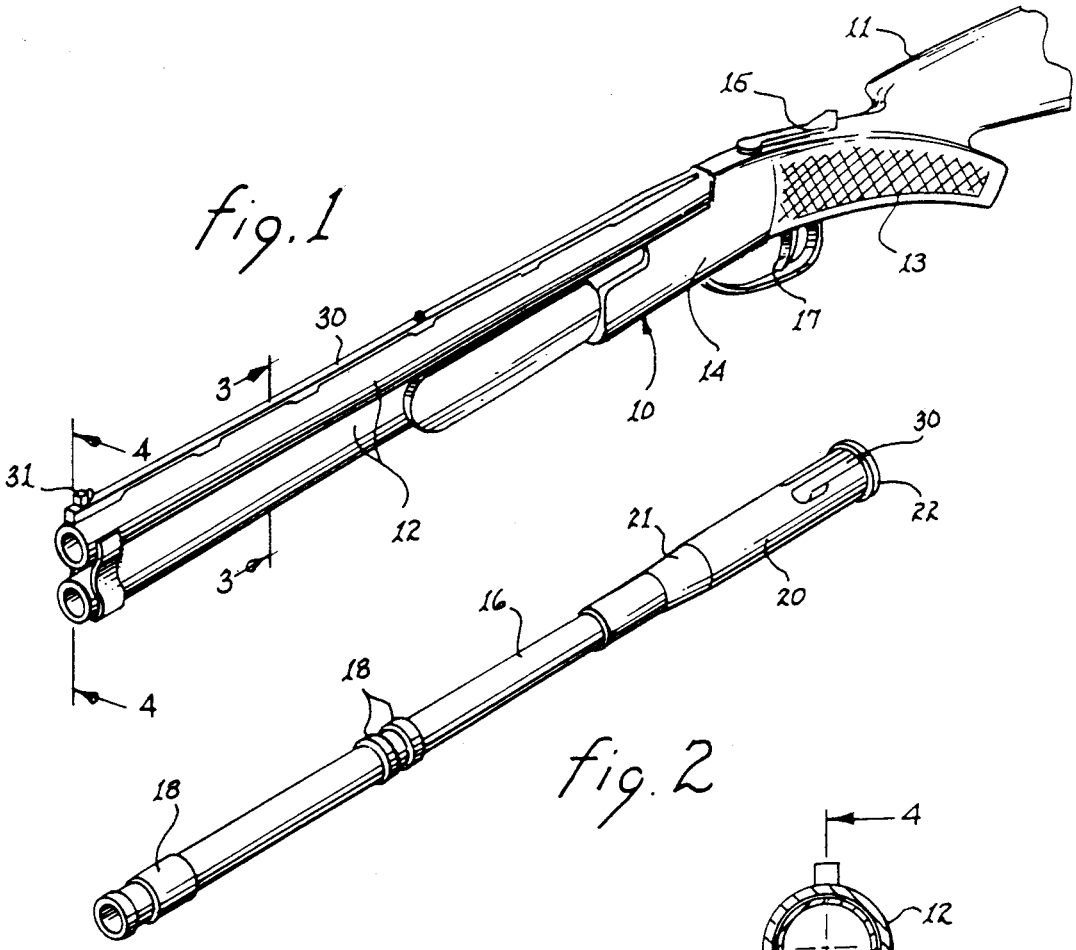
fig. 1
fig. 2
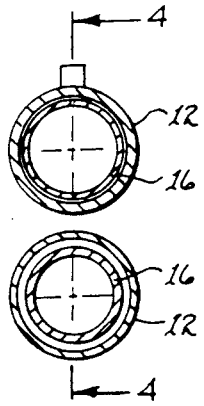
fig. 3
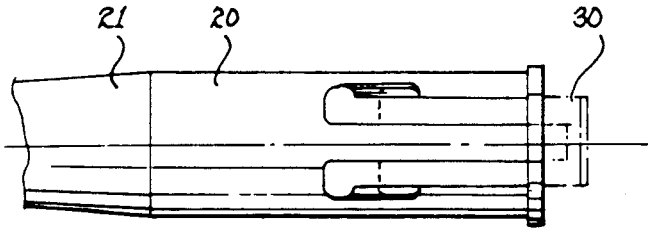
fig. 5
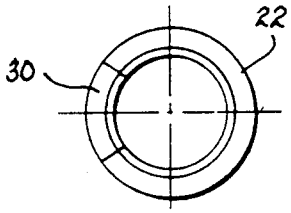
fig 6

SHOTGUN HAVING INTERCHANGEABLE BARRELS

FIELD OF THE INVENTION

The invention described herein relates generally to the field of shotguns. More particularly, this invention relates to shotguns with interchangeable barrels having different characteristics. In one embodiment of the present invention, a shotgun is provided with interchangeable barrels of varying gauge sizes matching the different desired barrel gauges for use in trap and skeet shooting competition.

DESCRIPTION OF THE PRIOR ART

A shotgun is a smooth bore shoulder arm primarily designed to fire small pellets called shot. Shotguns can be either single barreled or double-barreled; in double-barreled shotguns, the two barrels can be placed either side-by-side in horizontal alignment, or over-and-under in vertical alignment.

Shotgun barrels are made in different gauges, or bore sizes, ranging most commonly from 12 gauge (the largest), to 16 gauge, 20 gauge, 28 gauge, and 0.410 bore (the smallest). Individual barrels can also be distinguished by different choke patterns, which are constrictions made in the end of the barrel to control the shot pattern produced by the shotgun. A particular barrel gauge and choke pattern will be chosen based on the type of shooting to be done by the shotgun.

The clay target shooting games of trap and skeet are very popular uses for shotguns. In trap shooting competition, the shooter shoots five shots from five different positions three yards apart at rapidly rising single targets coming at various angles out of a trap house. The shooter can use either a single or double-barreled shotgun, and can also select any barrel gauge and choke pattern to use in the competition.

In skeet shooting, the shooter shoots from eight different stations at level-flying or falling targets discharged either from a high position or a low position. In contrast to trap, the typical skeet competition comprises the following four different classes, based primarily on different barrel gauges: the all-bore class (12 or 16 gauge), 20 gauge class, small-bore class (28 gauge or 0.410 bore with 0.75 ounce shot), and the sub-small bore class (0.410 bore with 0.50 ounce shot).

Competition shotguns are expensive, especially in skeet shooting, wherein many shooters compete in all four classes, requiring shotguns having at least three different barrel gauges. Therefore, several companies have provided interchangeable barrels for a single shotgun. For example, Krieghoff International, Inc. has available a K-80 4-Barrel Skeet set which includes a single shotgun stock and action together with 12 gauge, 20 gauge, 28 gauge, and 0.410 bore interchangeable barrels; all of the barrels are similar in weight. However, shotguns with separate barrels such as that mentioned above are very expensive. In an attempt to provide a method for reducing the expense of shotguns with different gauge barrels, the prior art has provided a 12 gauge barrel and a group of inexpensive barrel inserts commonly known as a "tube set". The tube sets in the various gauges are typically made of tubular hard anodized aluminum each of which may be inserted in the 12 gauge barrel of the shotgun; this system, though less expensive, presents a serious difficulty: the weight variation from gauge to gauge is substantial. The total weight may vary as much as sixteen ounces between the shotgun with simply the 12 gauge barrel installed, to the same shotgun with a tube installed within the 12 gauge barrel. As a result, the shooter must constantly adjust the swing and timing of his shooting when changing barrels, or changing from a barrel to a barrel with an insert tube, to compensate for the change in weight.

Attempts have been made in the prior art to compensate for weight variations of different barrels by supplying a detachable weight that can be secured to the forearm or barrel to add weight to the shotgun to present a total weight that is more consistent among the various barrel gauges. However, the concentration of this added weight destroys the weight distribution of the gun and thus its "handling"; the polar moment of inertia of the shotgun is radically changed by the concentration of such added weight at a particular location rather than the distribution of weight normally accompanied by a lighter or heavier barrel.

In view of the expense of additional barrels, particularly in the most common shotgun configuration used in competition (the over-and-under barrel arrangement), barrel inserts have been used. Normally, the shooter will use a 12 gauge as his basic gauge; to use the same shotgun in other gauge competition, barrel inserts are provided that can be slipped into the 12 gauge barrel to convert the shotgun to a smaller gauge as described above. Thus, although the utilization of barrel inserts may be less expensive than separate barrel sets, the difficulty with the handling and feel of the gun when using different gauges still exists.

SUMMARY OF THE INVENTION

The present invention incorporates an improvement in interchangeable shotgun barrels. In one embodiment, a cylindrical barrel support member is attached to a standard shotgun action. A plurality of barrels are provided which have similar weights and are sized and constructed to fit within and attach to the support member. Each of the barrels has a different gauge.

It is therefore an object of the present invention to provide a shotgun having interchangeable shotgun barrels such that the shotgun using the barrels will have a substantially constant polar moment of inertia.

It is another object of the present invention to provide a shotgun having interchangeable shotgun barrels of substantially equal weight.

It is another object of the present invention to provide interchangeable shotgun barrels which are inexpensive.

It is another object of the present invention to provide interchangeable shotgun barrels having a variety of gauge sizes.

Other objects, advantages and features of the present invention will become apparent from the following specification when taken in conjunction with the accompanying drawings.

BRIEF DESCRIPTION OF THE DRAWINGS

FIG. 1 is a schematic representation of a double-barreled, over-and-under shotgun incorporating the present invention.

FIG. 2 is a schematic representation of one of several interchangeable barrels of the present invention.

FIG. 3 is sectional view taken along line 3—3 of FIG. 1.

FIG. 5 is an enlarged view of one end of the interchangeable barrel of FIG. 2.

FIG. 6 is an end view of one end of the interchangeable barrel of FIG. 2.

DESCRIPTION OF THE PREFERRED EMBODIMENT

Figure 4:
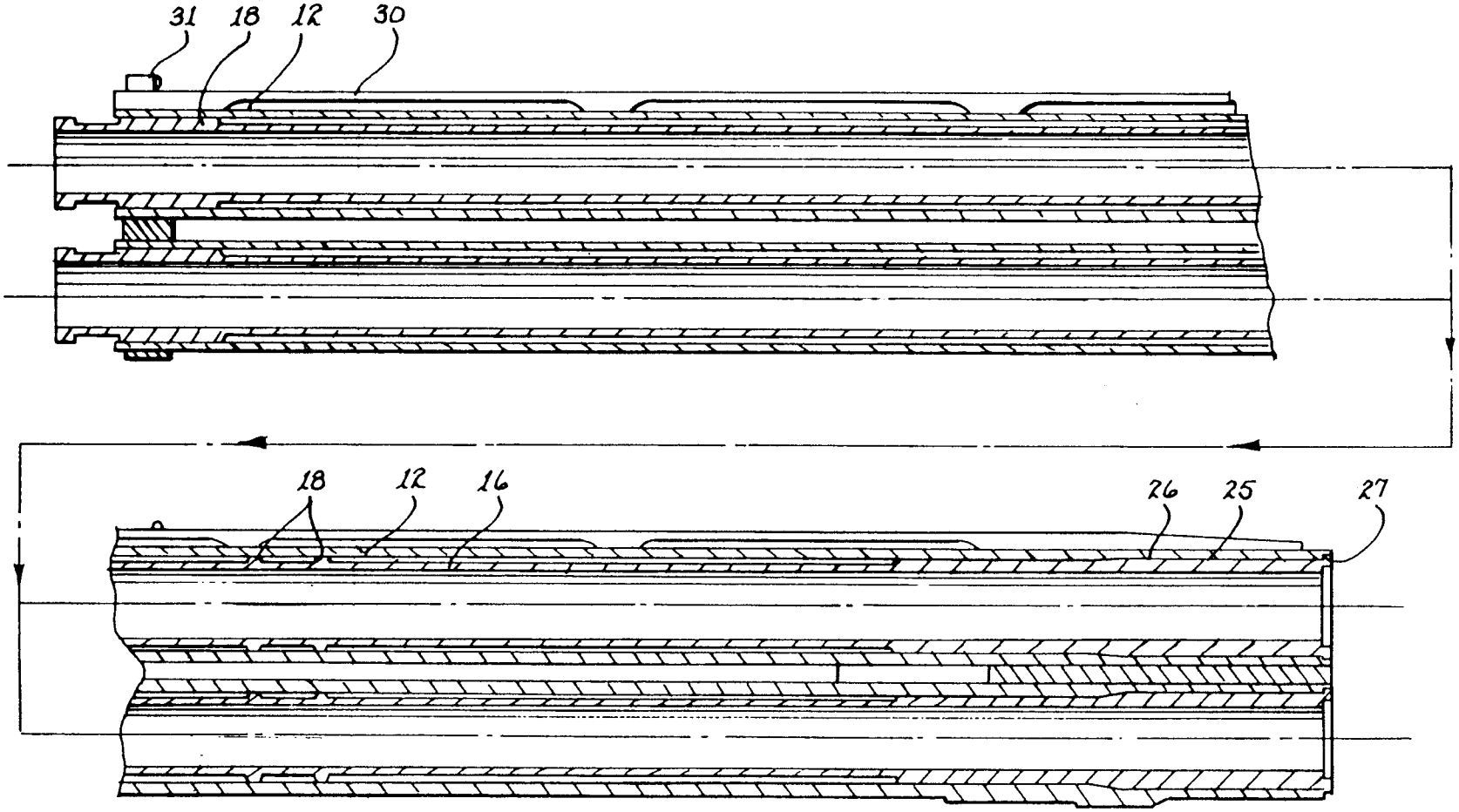
FIG. 4 is a sectional view taken along line 4—4 of FIG. 1.

The double-barreled shotgun 10 of the present invention illustrated in the accompanying drawings contains features common to all shotguns. Such features include a stock 11, a grip 13 attached to the stock 11, a breaking lever 15 and an action 14. The action 14 incorporates a conventional trigger mechanism 17 and a number of internal parts not shown, including firing pins, a safety, locking mechanism, and a mechanism such as a hinge or trunnions for pivotally supporting a matched pair of barrel support members 12 aligned vertically in an over-and-under configuration. The support members 12 can also be aligned in a side-by-side configuration. Alternatively, if a single-barreled shotgun is desired, only a single barrel support member need be used.

It is important to note that the support members 12 are not barrels and are completely incapable of accepting shells and operating in the capacity of a barrel. Indeed, the inside diameter of the barrel supports will be larger than the largest gauge shell which the shotgun is capable of accepting. The support members 12 will preferably be constructed of thin wall high tensile strength steel tubing having an internal diameter larger than the shotgun barrel external diameter and are intended solely to support the latter during operation and to reinforce and strengthen such barrels during firing.

Within the support members 12 are barrels 16 which slide into the support members 12 and lock into place by means of rings 18. The rings 18 have a diameter greater than the outside diameter of barrels 16 and slightly smaller than the inside diameter of support members 12. FIG. 3 is a cross-sectional view of the support members 12 and barrels 16 of FIG. 1; it may be noted that the gauge or bore of the upper and lower barrels is different. To provide required strength the barrel 16 is provided with an enlarged diameter chamber section 20 tapered at 21 to an outside diameter corresponding to the rings 18. The taper portion 21 as well as the flange 22 form a convenient stop for the positioning of the barrel 16 within the support member 12. Therefore, a corresponding mating enlarged inside diameter portion 25 with a corresponding tapering section 26 may be provided in the interior diameter of the support member; further, an annular recess 27 is provided to accept the flange 22.

The barrel 16 will operate in the normal manner in relation to the action 14. That is, the barrel 16 is supported in operative position with respect to the action to permit conventional operation of the shotgun. The flange 22 is interrupted to receive a slidable extractor 30; the extractor remains a part of the barrel 16 so that when a different barrel is used to accommodate a different gauge, the extractor of the new barrel is appropriate for the size of the cartridge being extracted. The extractor operates in a conventional manner by levers (not shown) typically used in shotguns, and may be of the selective type.

The various gauges provided by the interchangeable barrels 16 can be manufactured to have substantially equal weights by such manufacturing techniques as varying the wall thickness (within safety limits) as well as varying the number and length of the respective rings 18. Further, positioning the rings can also provide a means for "balancing" the respective barrels so that their individual polar moments of inertia can be close thus assuring the overall polar moment of inertia of the shotgun remains the same regardless of the gauge being used. Weight variations among the barrels of different gauge or bore can be limited to four ounces or less.

The barrels 16 may be matched for purposes of competition and be identical with the exception of their respective chokes. It may therefore be possible for a competitor to not only select matched barrels but also to interchangeably select choke patterns of the same gauge to meet the competition environment without affecting the weight or handling of his firearm. In the event the shotgun is to be used in the field, the present invention permits the utilization of separate gauges for each of the two barrels. Although not normally recommended, it would be possible to combine for example a 12 gauge and a 0.410 bore barrel in the double barreled shotgun. This latter combination, while usually not recommended for normal shotgun use, may nevertheless find utilization in those environments where one of the barrels is being used to fire slugs (e.g. 0.410 bore rifled slug) and the other is being used for conventional shotgun pellets. Such combinations may find use under certain field conditions and types of game.

The shotgun of the present invention with interchangeable barrels as illustrated in the drawings can therefore be successfully used in all four classes of sheet shooting competitions. The shooter need only select the appropriate gauge or bore and proceed with the competition while having in hand a firearm that is comfortable and familiar. Indeed, the competitor can compete in all four classes without surrendering the familiarity of his "favorite" shotgun. Of course, it would be possible to have four separate shotguns or to have a shotgun with four interchangeable barrels as discussed above in connection with the prior art; however, the extraordinary expense involved with such a combination militates against the use of such prior art techniques to avail the shooter of constant weight and handling characteristics. Because the shotgun of the present invention will have substantially the same weight regardless of gauge or bore, and since the shotgun dynamics in handling, most importantly the polar moment of inertia, will remain the same regardless of the gauge or bore, the shooter will not have the disadvantage of awkwardness or unfamiliarity when changing gauge for a different competition. Significantly, these advantages are achieved must less expensively than the prior art.

It may therefore be seen that a shooter may wish to utilize a barrel, or a pair of barrels if the shotgun is a double, designed to a particular shooting environment. For competition the shooter may desire a particular combination of choke patterns; however, even though the shooter may desire the same gauge for field shooting, the gauge patterns may not be appropriate. It is only necessary that the shooter substitute a particular gauge barrel having the desired choke for the barrel of that gauge that he uses in competition.

It is important to note that the barrel support gives the appearance of a standard shotgun barrel with the appropriate bluing or other high quality finish. The barrel support may be engraved or may be utilized to support a ventilated rib 30 or other sighting aids such as a sight bead 31. The function of the barrel support, other than its appearance and support of sighting aids, is merely to enclose, support, and contribute to the strength of the barrel that is placed within the support; that is, the barrel support does not contain a chamber and cannot act as a barrel. If the shotgun is a double-barreled shotgun, then the barrel supports provide the additional function of aligning the barrels with respect to each other.

It is to be understood that the present invention is not limited to the particular construction and arrangement of parts disclosed and illustrated herein but embraces all such modified forms thereof which are within the scope of the following claims.

What is claimed is:

1. In a shotgun having an action, the improvement comprising: a cylindrical barrel support member pivotally secured to said action; a plurality of barrels, each having the same predetermined weight and each having a different gauge or bore, each of said barrels having an external diameter selected to fit within said support member in operative position with respect to said action to thereby permit the selective utilization of one of said barrels in said cylindrical barrel support of said shotgun.

2. In a shotgun having an action, the improvement comprising: a pair of cylindrical barrel supports secured to each other and pivotally secured to said action; a pair of barrels each having a predetermined gauge or bore and having an external diameter selected to fit within one of said support members in operative position with respect to said action.

3. The combination set forth in claim 2 wherein said cylindrical barrel supports are positioned side-by-side.

4. The combination set forth in claim 2 wherein said cylindrical barrel support members are positioned one on top of the other in an over-under configuration.

5. The combination set forth in claim 2 wherein the barrel of each pair of barrels has a different choke.

6. In a shotgun having an action, the improvement for interchanging barrels comprising:

a pair of cylindrical barrel support members pivotally secured to said action;

a plurality of matched pairs of barrels each of predetermined weight and chosen gauge or bore, and each having an external diameter selected to fit within one of said support members in operative position with respect to said action;

each of said pairs of barrels having substantially the same weight as the other pairs of barrels.

7. The combination set forth in claim 6 wherein the barrel of each pair of barrels has a different choke.

* * * * *